US005779606A

United States Patent [19]

Chen

[11] Patent Number: 5,779,606

[45] Date of Patent: Jul. 14, 1998

[54] MULTI-FUNCTION EXERCISER

[75] Inventor: Chin-Jung Chen, Taichung, Taiwan

[73] Assignee: Fit-Right Enterprise Co., Ltd., Taichung, Taiwan

[21] Appl. No.: 696,552

[22] Filed: Aug. 14, 1996

[51] Int. Cl.[6] ..... A63B 21/04

[52] U.S. Cl. ..... 482/130; 482/138

[58] Field of Search ..... 482/129, 130, 482/133, 137, 138, 140

[56] References Cited

U.S. PATENT DOCUMENTS 3,558,131 1/1971 Dragon ..... 482/130

FOREIGN PATENT DOCUMENTS 542441 5/1993 European Pat. Off. ..... 482/130

*Primary Examiner*—Richard J. Apley
*Assistant Examiner*—John Mulcahy
*Attorney, Agent, or Firm*—Townsend and Townsend and Crew LLP

[57] ABSTRACT

An exerciser includes an elongated main frame having spine-exercising device and a leg-exercising device at its front end. A first pulley assembly is mounted between the leg-exercising device and the rear support rod of the exerciser and has a pair of first elastic cords which pass around the first pulley assembly and which are connected to the leg-exercising device in order to exert a resistant force to the leg-exercising device. A second pulley assembly is mounted on either side of main frame and has a pair of second elastic cords passing around the second pulley assembly. The second elastic cords can be pulled away from the main frame to a horizontal position so that the user can expand his/her chest.

4 Claims, 13 Drawing Sheets

MULTI-FUNCTION EXERCISER

BACKGROUND OF THE INVENTION

1. Field of the Invention

This invention relates an exerciser, more particularly to a multi-function exerciser which can perform a large number of exercises.

2. Description of the Related Art

Referring to FIG. 1, a conventional sit-up bench 10 is shown to comprise a front support rod 11, a rear support rod 12, a coupling member 13, and a pulley assembly 15. The front support rod 11 has telescoping outer and inner tubes 111, 112. The front and rear side faces of the outer and inner tubes 111, 112 has a plurality of positioning holes 113 for height-adjusting purposes. A first transverse bar 114 with foamed rubber is fixed to a U-shaped member 115. A screw fastener 116 extends through the first transverse bar 114, the U-shaped member 115 and the two of the positioning holes 113 in order to affix the inner tube 112 to the outer tube 111. The rear support rod 12 is generally T-shaped and has a lateral rod 121 and a longitudinal rod 122 which is connected to the intermediated portion of the lateral rod 121. The longitudinal rod 122 is connected inclinedly to the upper end of the inner tube 112 at its distal end by means of the coupling member 13. An elongated board 123 is fixed to the upper side of the longitudinal rod 122. A second transverse bar 141 with foamed rubber is fixed over the upper end of the inner tube 112 by means of a connecting tube 14 which interconnects the second transverse bar 141 and the coupling member 13. Therefore, the user can lie down on the board 123 with legs hooked on the first transverse bar 114 so as to perform the sit-up exercise. The pulley assembly 15 has a pair of first pulleys 151 which are mounted to either side of the longitudinal rod 122 adjacent to its distal end, and a pair of second pulleys 152 which are mounted to either side of the longitudinal rod 122 adjacent to the lateral rod 121. Two elastic cords may pass around the first and second pulleys 151, 152 on the respective sides of the longitudinal rod 122 under tension in order to exercise the user's arms. However, the conventional sit-up bench 10 cannot be used to expend the chest and exercise the legs of the user.

SUMMARY OF THE INVENTION

It is therefore a main object of the present invention to provide a multi-function exerciser which overcomes the shortcomings associated with the conventional sit-up bench.

According to the present invention, the exerciser comprises an elongated main frame having spine-exercising device and a leg-exercising device at its front end. A first pulley assembly is mounted between the leg-exercising device and the rear support rod of the exerciser and has a pair of first elastic cords which pass therearound and which are connected to the leg-exercising device in order to exert a resistant force to the same. A second pulley assembly is mounted on either side of main frame and has a pair of second elastic cords passing therearound. The second elastic cords can be pulled away from the main frame so that the user can expand his/her chest.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENT

Figure 1:
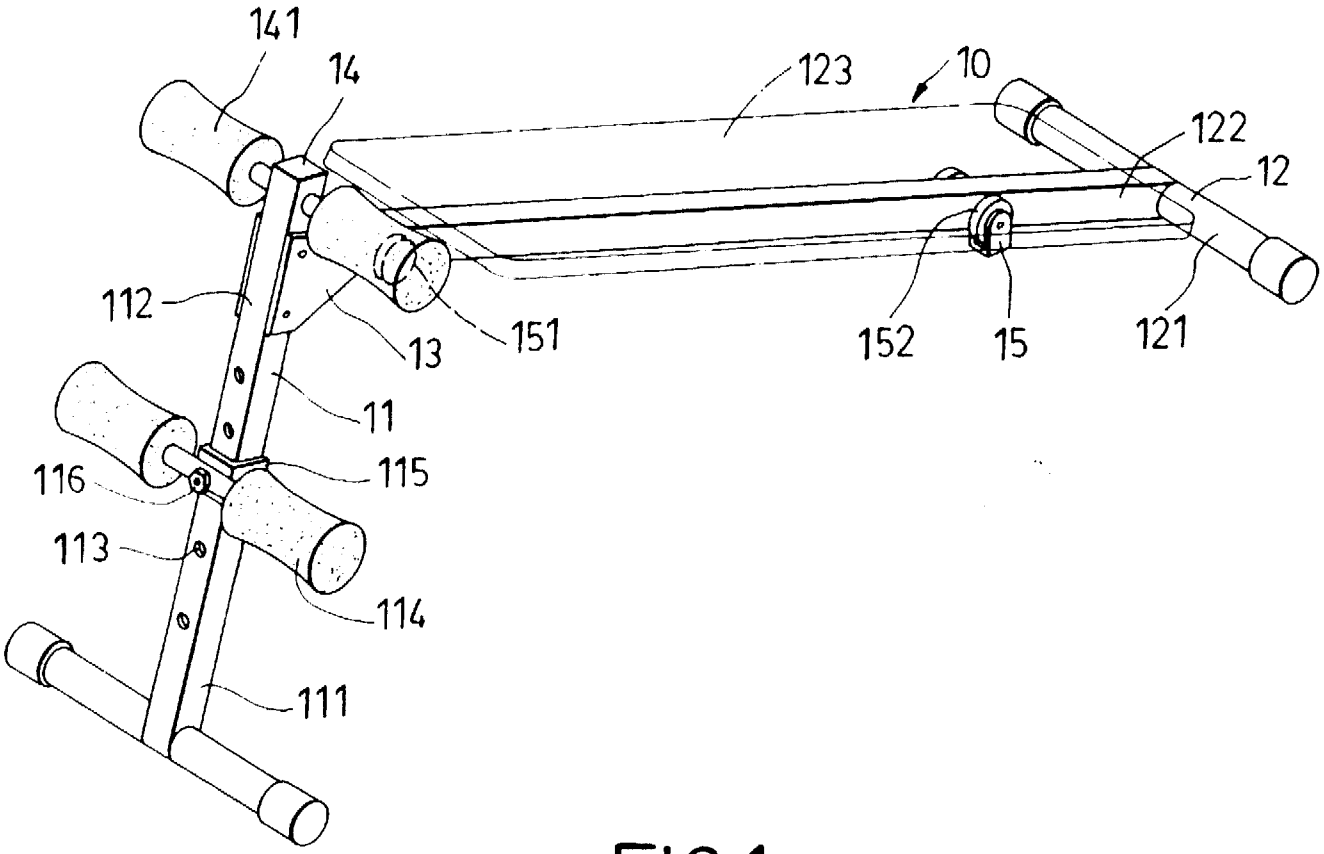
FIG.1 PRIOR ART
FIG. 1 is a perspective schematic view of a conventional sit-up bench.
Figure 2:
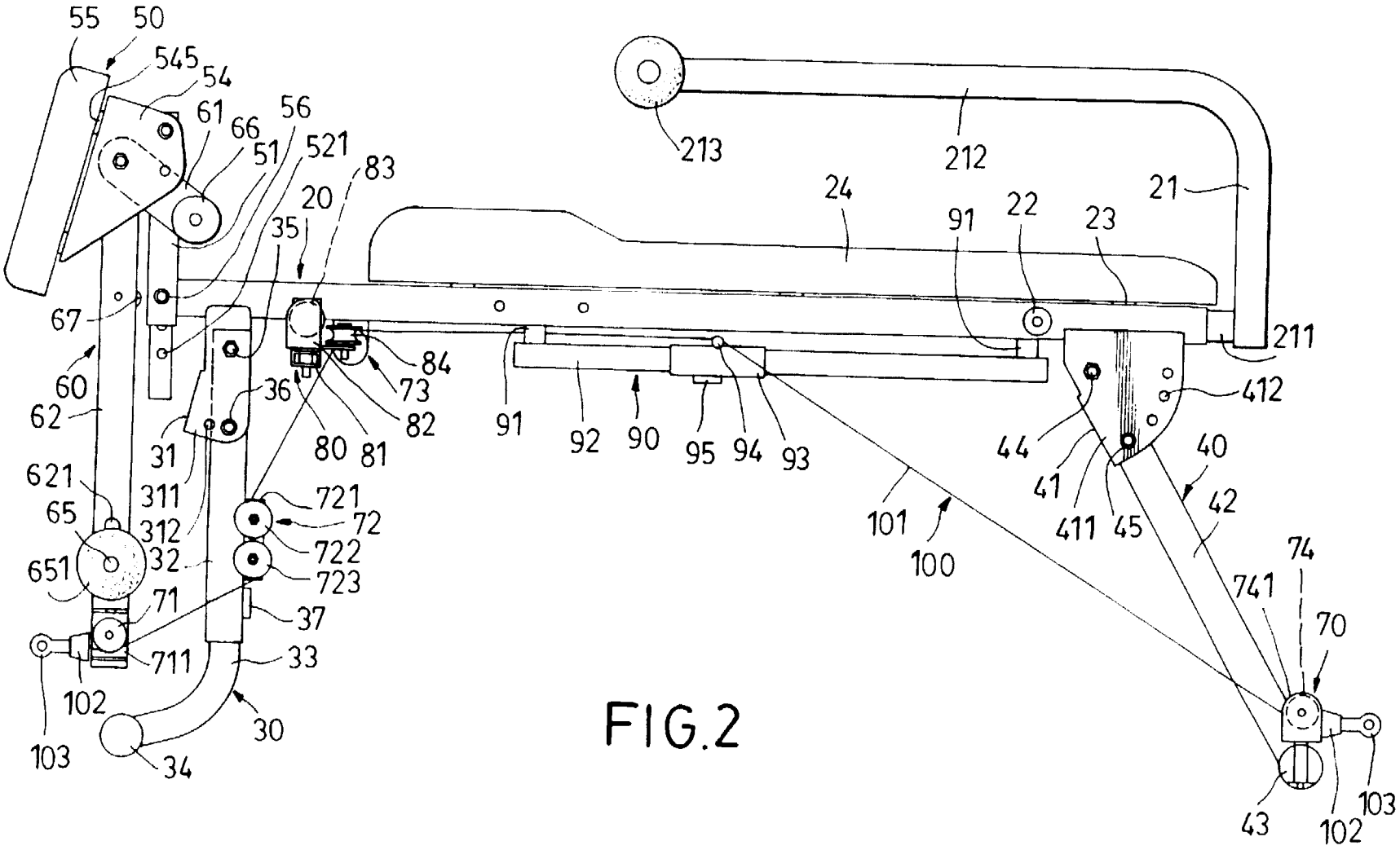
FIG. 2 is a schematic side view of a preferred embodiment of an exerciser according to the present invention.
Figure 3:
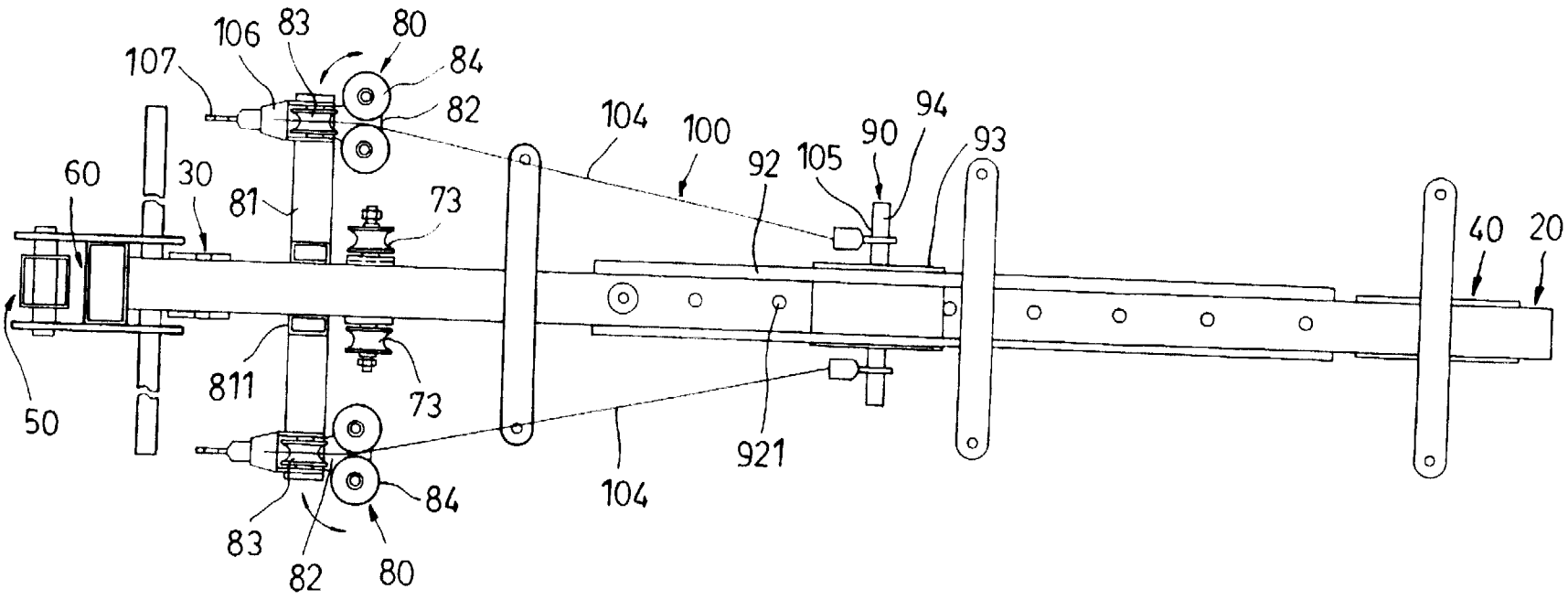
FIG. 3 is a schematic top view of the exerciser according to the present invention, in which the seat member and the U-shaped abutting member are not mounted to the main frame of the exerciser.

Referring to FIGS. 2 and 3, a preferred embodiment of an exerciser according to the present invention is shown to comprise a main frame 20, a front support rod 30, a rear support rod 40, a spine-exercising device 50, a leg-exercising device 60, a first pulley assembly 70, a second pulley assembly 80, a tension-adjusting device 90 and two pairs of elastic cords 100. The front and rear support rods 30 and 40 are fixed respectively to the front and rear ends of the main frame 20. The spine-exercising device 50 is mounted to the front end of the main frame 20. The leg exercising device 60 is mounted in front of the spine-exercising device 50. The first pulley assembly 70 is mounted between the rear support rod 40 and the leg-exercising device 60. The second pulley assembly 80 is mounted on either side of the main frame 20. The tension-adjusting device 90 is mounted to the lower side face of the main frame 20. The pairs of the elastic cords 100 pass around the respective pulley assemblies 70, 80.

Figure 6:
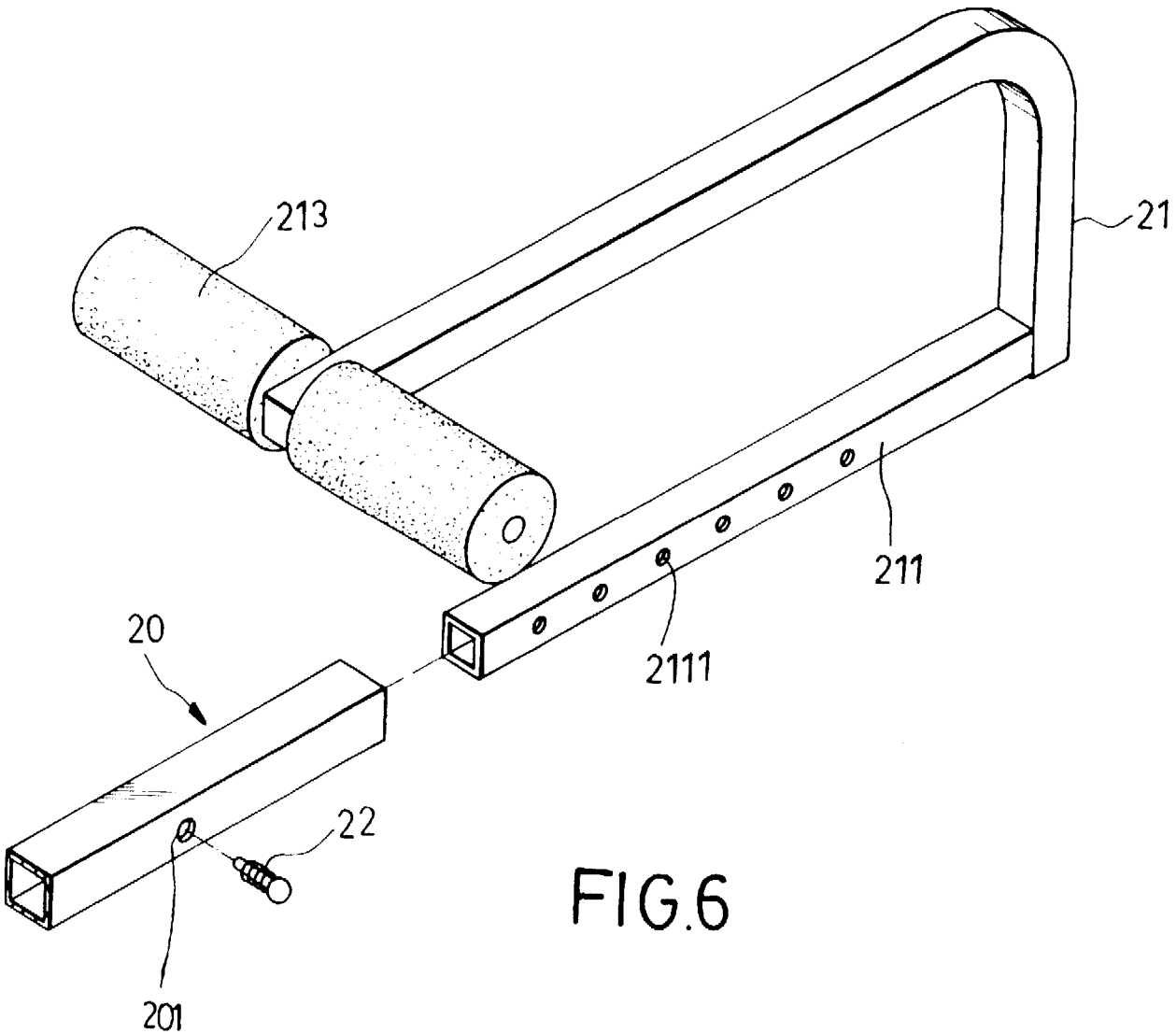
FIG. 6 is an exploded view illustrating how the U-shaped abutting member is connected to the rear end of the main frame.

The main frame 20 is formed of a hollow tube and has a U-shaped abutting member 21 mounted to its rear end. The U-shaped abutting member 21 has a first leg portion 211 which is inserted slidably into the main frame 20 and which has a plurality of adjusting holes 2111 formed in one side face thereof, as shown in FIG. 6. The U-shaped abutting member 21 further has a second leg portion 212 which is located spacedly over the main frame 20. The distal end of the second leg portion 212 has a transverse rod 213 connected thereto. The transverse rod 213 is wrapped by a foamed rubber. One side of the main frame 20 has a positioning hole 201 which is aligned selectively with one of the adjusting holes 2111 by means of moving the U-shaped abutting member 21 relative to the main frame 20. A spring pin 22 is inserted into the positioning hole 201 and the aligned adjusting hole 2111 in order to position the U-shaped abutting member 21 relative to the main frame 20. Therefore, the position of the U-shaped abutting member 21 is adjustable relative to the main frame 20. The upper side face of the main frame 20 has a plurality of connecting plates 23 fixed thereto. A seat member 24 is fixed over the connecting plates 23.

Figure 7:
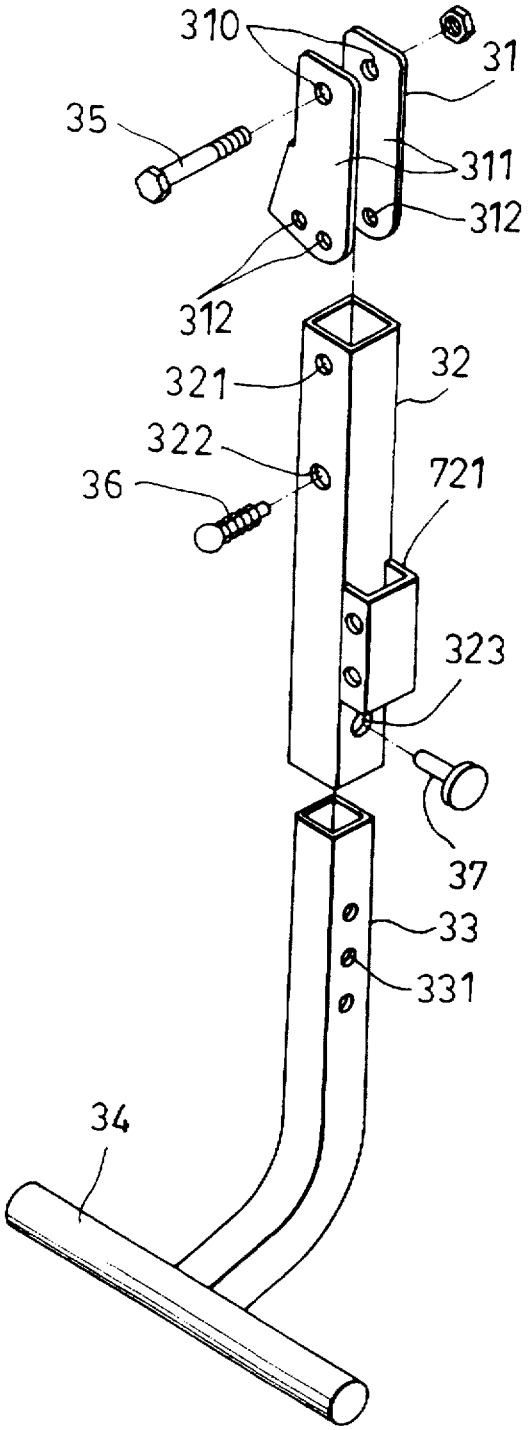
FIG. 7 is an exploded view illustrating how the front support rod is connected to a coupling member of the main frame according to the present invention.

Referring to FIGS. 2 and 7, the front support rod 30 has a first coupling member 31, telescoping outer and inner tubes 32, 33, and a front bottom rod 34. The first coupling member 31 has two opposed wing members 311 which are fixed to the front, lower side face of the main frame 20. The wing members 311 are formed with upper pivot holes 310 and lower angle-adjusting holes 312. One side of the outer tube 32 has a through hole 321 which is aligned with the upper pivot holes 310, an upper positioning hole 322 which is aligned selectively with one of the lower angle-adjusting holes 312. The upper end of the outer tube 32 may be connected pivotally to the first coupling member 31 by means of extending a pivot pin 35 with two threaded ends through the upper pivot holes 310 and the through hole 321 and by means of engaging two screw nuts with the threaded ends of the pivot pin 35. The outer tube 32 and the main frame 20 may form a selected angle by means of inserting a spring pin 36 into a selected one of the adjusting holes 312 and the upper positioning hole 322 of the outer tube 32. The rear side of the outer tube 32 has a lower positioning hole 323 formed therein. The inner tube 33 has lower curved portion with a lower end which is connected transversely to the front bottom rod 34. The rear side of the inner tube 33 has a plurality of length-adjusting holes 331 formed therein. The length of the front support rod 30 is adjustable by means of inserting a lock pin 37 into the lower positioning hole 323 of the outer tube 32 and a selected one of the length-adjusting holes 331.

Figure 8:
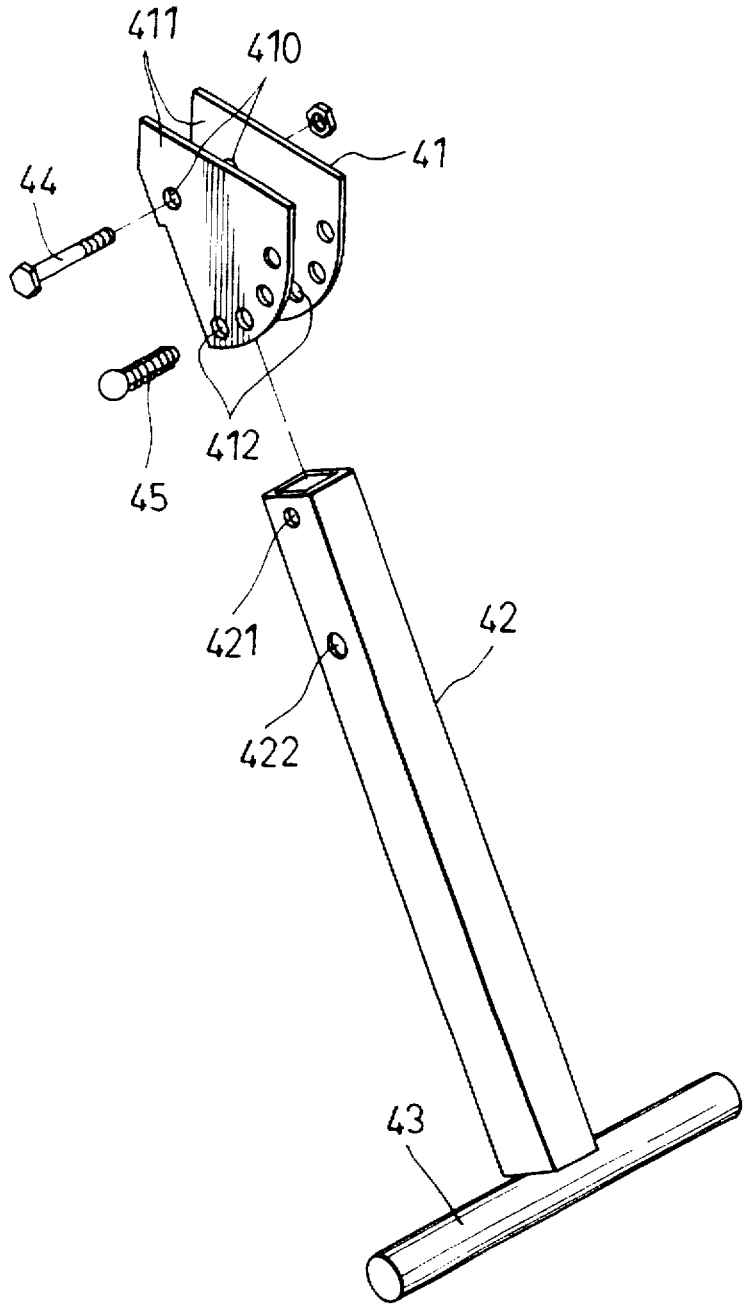
FIG. 8 is an exploded view illustrating how the rear support rod is connected to a coupling member of the main frame according to the present invention.

Referring to FIGS. 2 and 8, the rear support rod 40 has a second coupling member 41, a straight shaft 42 and a rear bottom rod 43. The second coupling member 41 has two wing members 411 which are fixed to the lower side face of the rear end of the main frame 20. The wing members 411 have two aligned pivot holes 410 and a number of aligned angle-adjusting holes 412. The shaft 42 has a through hole 421 which is aligned with the pivot holes 410, a positioning hole 422 which is aligned selectively with one of the angle-adjusting holes 412. The upper end of the shaft 42 may be connected pivotally to the second coupling member 41 by means of extending a pivot pin 44 with two threaded ends through the pivot holes 410 and the through hole 421 and by means of engaging two screw nuts and the threaded ends of the pivot pin 44. The shaft 42 and the main frame 20 may form a selected angle by means of inserting a spring pin 45 into a selected one of the adjusting holes 412 and the positioning hole 422. The lower end of the shaft 42 is connected transversely to the rear bottom rod 43.

Figure 4:
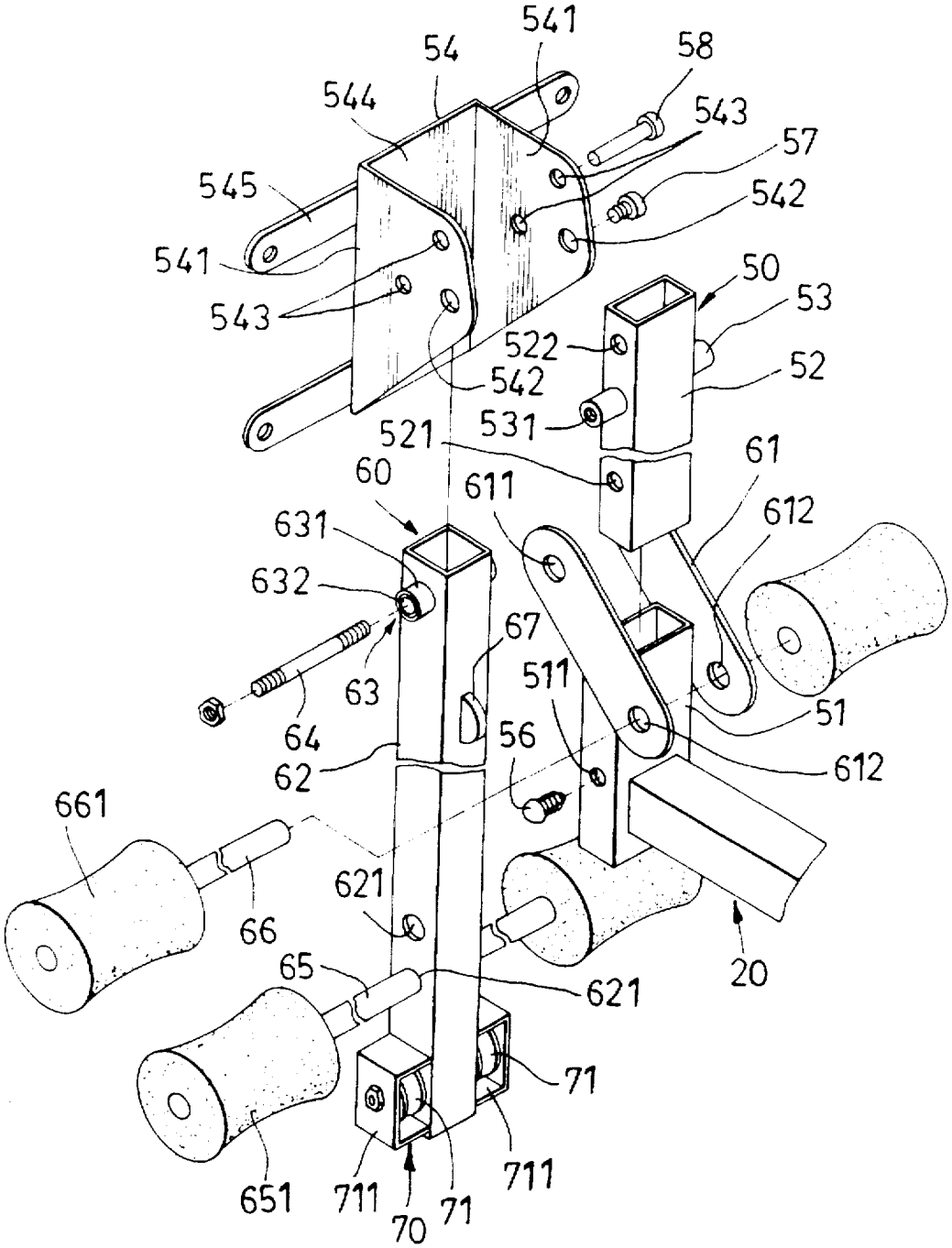
FIG. 4 is an exploded view of the spine-exercising and the leg-exercising devices of the exerciser according to the present invention.

Referring to FIGS. 2 and 4, the spine-exercising device 50 is shown to comprise telescoping outer and inner tubes 51, 52, a U-shaped bracket 54 and an abutting plate 55. The lower end of the outer tube 51 of the spine-exercising device 50 is fixed to the front end of the main frame 20. The outer tube 51 has a positioning hole 511 and the inner tube 52 has a plurality of height-adjusting holes 521 so that the inner tube 52 can be positioned in the outer tube 51 by means of inserting a locking pin 56 into the positioning hole 511 and one of the height-adjusting holes 512. The upper portion of the inner tube 52 has a coupling rod 53 and a positioning hole 522 extending transversely therethrough. The coupling rod 52 has two threaded holes 531 in the respective ends thereof. Two opposed wing members 541 of the U-shaped bracket 54 are formed with two positioning holes 542 and two pairs of angle-adjusting holes 543. The coupling rod 52 is disposed between the wing members 541 such that the positioning hole 542 are aligned with the threaded holes 531. Two screw members 57 extend through the positioning holes 542 and engage the threaded holes 531 and a positioning pin 58 is inserted into the one of the angle-adjusting holes 543 and the positioning holes 542 in order to position the inner tube 52 with respect to the U-shaped bracket 54. The back plate 544 of the U-shaped bracket 54 has two connecting plates 545 fixed thereto. The abutting plate 55 is fixed to connecting plates 545 of the U-shaped bracket 54.

The leg-exercising device 60 has a pair of elongated connecting plates 61, a swing rod 62 and a sleeve member 63. The connecting plates 61 are fixed parallelly to the opposed sides of the upper end of the outer tube 51 of the spine-exercising device 50. The upper and lower ends of the connecting plates 61 are formed respectively with aligned pivot holes 611 and through holes 612. The swing rod 62 is a hollow shaft. The sleeve member 63 extends transversely through the upper portion of the swing rod 62. The sleeve member 63 has an outer sleeve 631 and an inner sleeve 632 received rotatably in the outer sleeve 631. A pivot pin 64 with two externally threaded ends extends through the pivot holes 611 of the connecting plates 61 and two nuts engage the threaded ends of the pivot pin 64 in order to connect pivotally the swing rod 62 to the connecting plates 61. The lower portion of the swing rod 62 has two pairs of height-adjusting holes 621 formed therethrough, and a shaft 65 extending through one pair of height-adjusting holes 621. Two foamed members 651 are connected to the respective ends of the shaft 65. A handle 66 extends through the through holes 612 of the connecting plates 61. Two foamed members 661 are connected to the respective ends of the handle 66. The rear side of the swing rod 62 is formed with a cushion pad 67 in order to prevent collision of the swing rod 62 and the outer tube 51.

The first pulley assembly 70 includes a pair of front pulleys 71, two pairs of first middle pulleys 72, a pair of second middle pulleys 73 and a pair of rear pulleys 74. The front pulleys 71 are mounted rotatably to the lower end of the swing rod 62 on either side of the latter by means of two U-shaped mounting seats 711, as best illustrated in FIG. 4. The two pairs of the first middle pulleys 72 are mounted rotatably to the outer tube 32 of the front support rod 30 side by side by means of two U-shaped mounting seats 721 (only one pair of the first middle pulleys 72 are shown in FIG. 2). Each pair of the first middle pulleys 72 has a lower pulley 722 and an upper pulley 723 which are mounted in the respective one of the U-shaped mounting seats 721. The second middle pulleys 73 are mounted rotatably to the lower side face of the main frame 20 on either side of the main frame 20 behind the front support rod 30, as best illustrated in FIG. 3. The rear pulleys 74 are mounted rotatably to the lower end of the rear support rod 40 on either side of the rear support rod 40 by means of U-shaped mounting seats 741 (only one rear pulley 74 is shown in FIG. 2).

Figure 5:
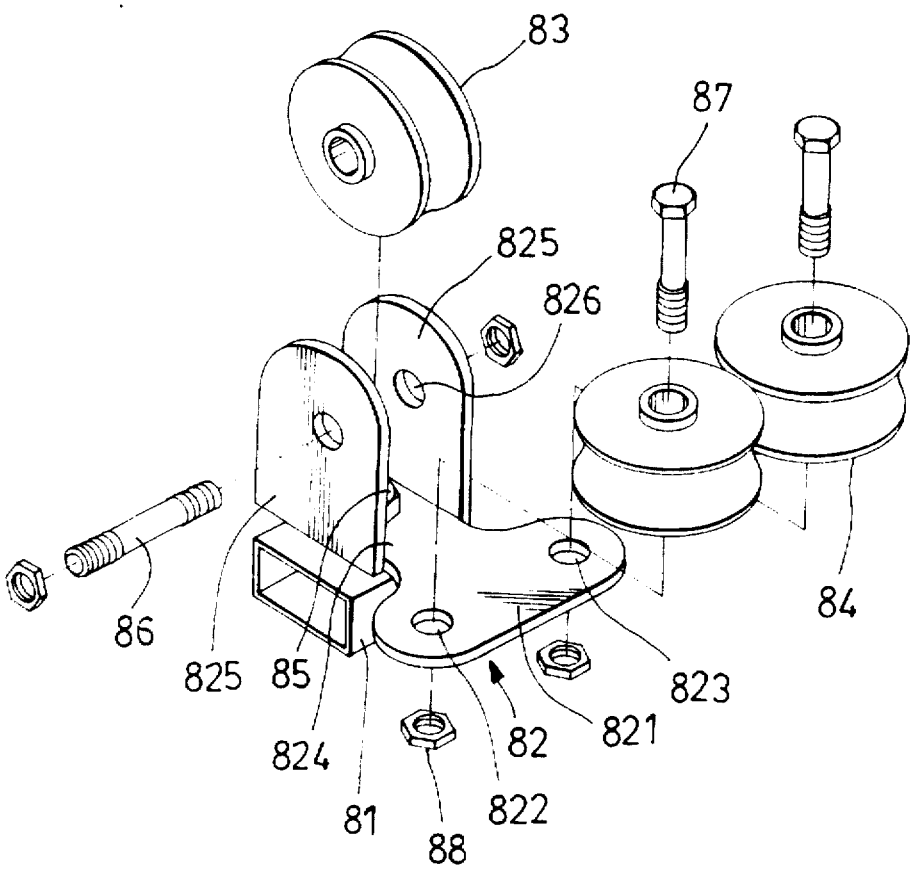
FIG. 5 is an exploded view of the second pulley assembly of the exerciser according to the present invention.

The second pulley assembly 80 includes a mounting rod 81 which is connected transversely to the main frame 20 between the front support rod 30 and the second middle pulleys 73 by means of a connecting seat 811, as best illustrated in FIG. 3. Each end of the mounting rod 81 has a generally T-shaped member 82 which has a tail portion 824 and a head portion 821 transversely connected to the tail portion 824, as shown in FIG. 5. Each tail portion 824 is connected pivotally to a respective one of the ends of the mounting rod 81 by means of a pivot pin 85 and has a pair of opposed wing members 825 extending upwardly therefrom. The ends of the head portion 821 has two through holes 822, 823 formed therein. The wing members 825 have two aligned holes 826 formed therein. The wing members 825 has a bobbin 83 mounted rotatably therebetween by means of a pivot pin 86 with two threaded ends which extends through the holes 826 and the bobbin 83 and which has two nut members engaged with the threaded ends thereof. Each of the head portions 821 has a pair of guiding rollers 84 mounted rotatably to its upper face by means of bolts 87 and nuts 88. Each of the bolts 87 extends through the corresponding one of guiding rollers 84 and the through holes 822, 823 and engages the corresponding one of the nuts 88.

Referring to FIGS. 2 and 3, the tension-adjusting device 90 is mounted to the main frame 20 between the second middle pulleys 73 and the rear support rod 74 and has two connecting blocks 91, a guiding rod 92 connected to the connecting blocks 91 in order to be fixed under the lower side face of the main frame 20. The guiding rod 92 has a plurality of adjusting holes 921 formed therein. A slide tube 93 is sleeved slidably on the guiding rod 92. A fastening device which is in the form of a lock pin 95 is connected to the slide tube 93 and is inserted into a selected one of the adjusting holes 921 for positioning releasably the slide tube 93 to the guiding tube 92. A retaining rod 94 is fixed to the slide tube 93.

Figure 9:
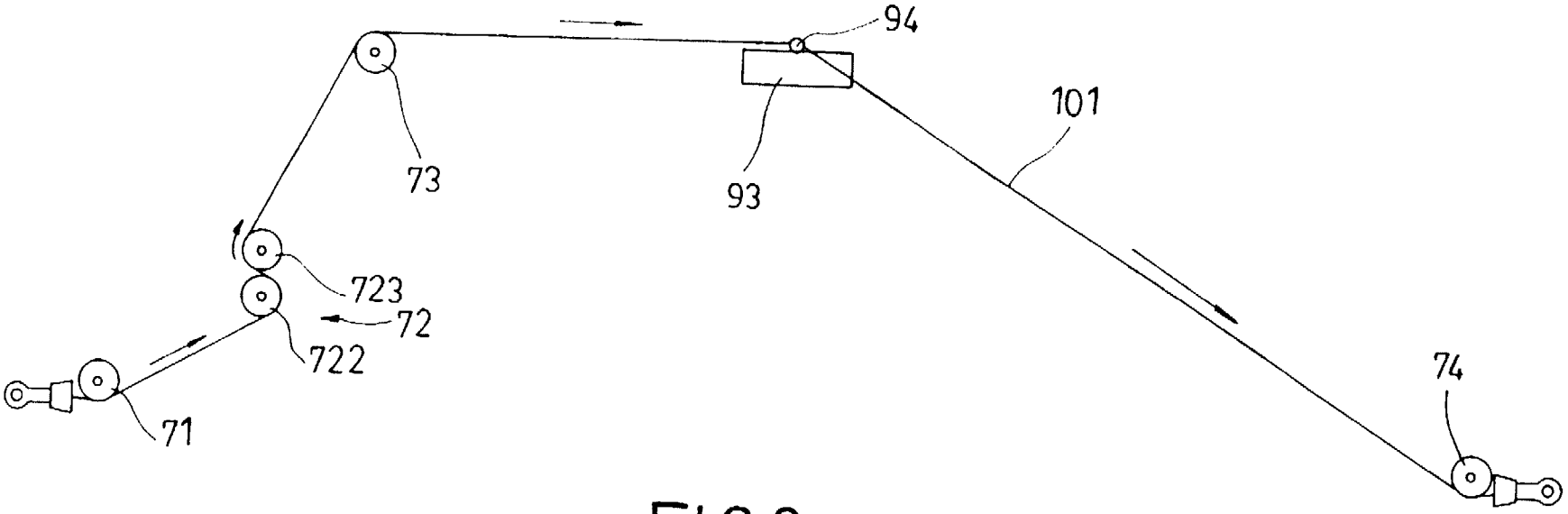
FIG. 9 is a schematic view illustrating how the first cords pass around the first pulley assembly according to the present invention.

The elastic cords 100 includes a pair of first cords 101 and a pair of second cords 104. Referring to FIGS. 2 and 9, each of the first cords 101 passes around a respective one of the front pulleys 71, the lower and upper pulleys 722, 723 of a respective one pairs of the first middle pulleys 72, a respective one of the second middle pulleys 73, the retaining rod 94, and a respective one of the rear pulleys 74. Each end of the first cords 101 has a first retaining block 102 and a first hooking ring 103 connected thereto. The first retaining blocks 102 of the first cords 101 abut respectively against the front pulleys 71 and the rear pulleys 74 in order to keep the first cords 101 under tension. Therefore, the user can connect exercising strips (not shown) to the first hooking rings 103 and pull the exercising strips against the restoring force of the first cords 101 for exercising purposes.

Referring to FIG. 3, each of the second cords 104 passes around the bobbin 83 and one of the guiding rollers 84 of a respective one of the ends of the mounting rod 81. Each of the second cords 104 has first and second ends. The first ends of the second cords 104 have second hooking rings 105 which are connected to the retaining rods 94 of the tension-adjusting device 90. The second end of each of the second cords 104 has a second retaining block 106 and a third hooking ring 107 connected thereto. The second retaining blocks 106 abuts the bobbins 83 of the second pulley assembly 80 in order to keep the second cords 104 under tension. Therefore, the user can connect exercising strips (not shown) to the third hook rings 107 and pull the exercising strips against the restoring force of the second cords 104 for exercising purposes.

The operations of the exerciser of the present invention are described as follows.

Figure 10:
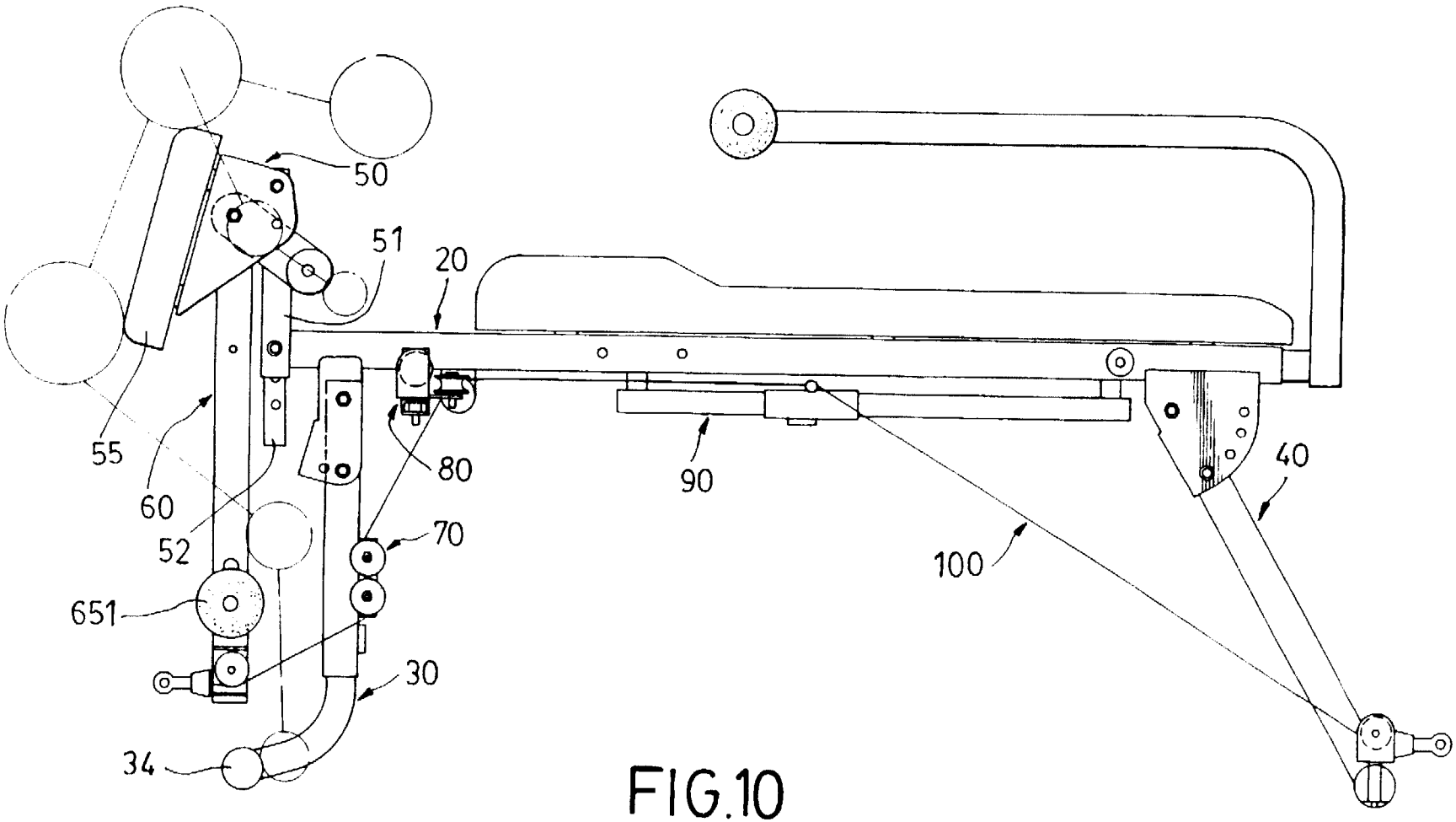
FIG. 10 is a schematic view illustrating how the spine-exercising device is used according to the present invention.

Referring to FIG. 10, the inner tube 52 is first moved relative to the outer tube 51 in order to be adjusted to a proper height. The user stands on the front bottom rod 34, facing the rear end of the main frame 20 with his/her legs' back sides abutting against the foam members 651 and with his/her abdomen abutting against the abutting plate 55. Thereafter, the user bends his/her trunk back and forth in order to exercise the spine.

Figure 11:
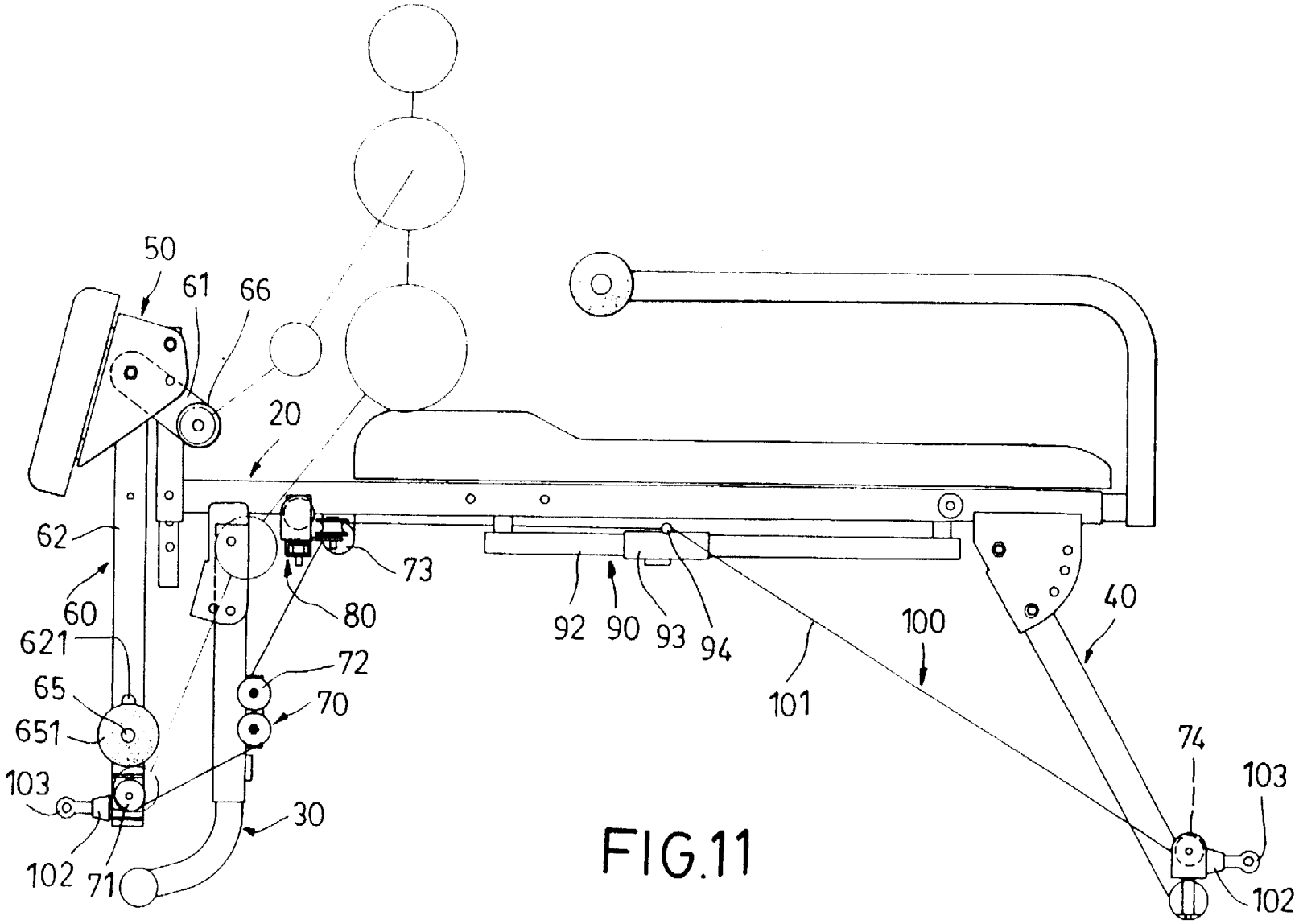
FIG. 11 is a schematic view illustrating how the leg-exercising device is used according to the present invention.

Referring to FIG. 11, the user sits on the seat member 24, facing the leg-exercising device 60 and then grasps the handle 66 with his/her legs abutting the lower sides of the foamed members 651. At this time, the user may lift his/her legs to rotate the swing rod 62 about the outer sleeve 631 against the restoring force of the first cords 101 in order to exercise his/her legs. Since there are two height-adjusting holes 621 in the swing rod 62, the height of the shaft 65 is adjustable in order to allow the user's legs to be disposed on the rear sides of the foamed members 651. In addition, because the first cords 101 pass over the retaining rods 94, when the length of the first cords 101 between the ends of the first cords 101 to be pulled is smaller than that of the remaining parts of the first cords 101, the resistant force exerted on the legs is larger. On the contrary, when the length of the first cords 101 between the ends of the first cords 101 to be pulled is greater than that of the remaining parts of the first cords 101, the resistant force exerted on the legs is smaller. That is, by changing the position of the slide tube 93 with respect to the guiding tube 92, the tension of the first cords 101 can be adjusted.

Figure 12:
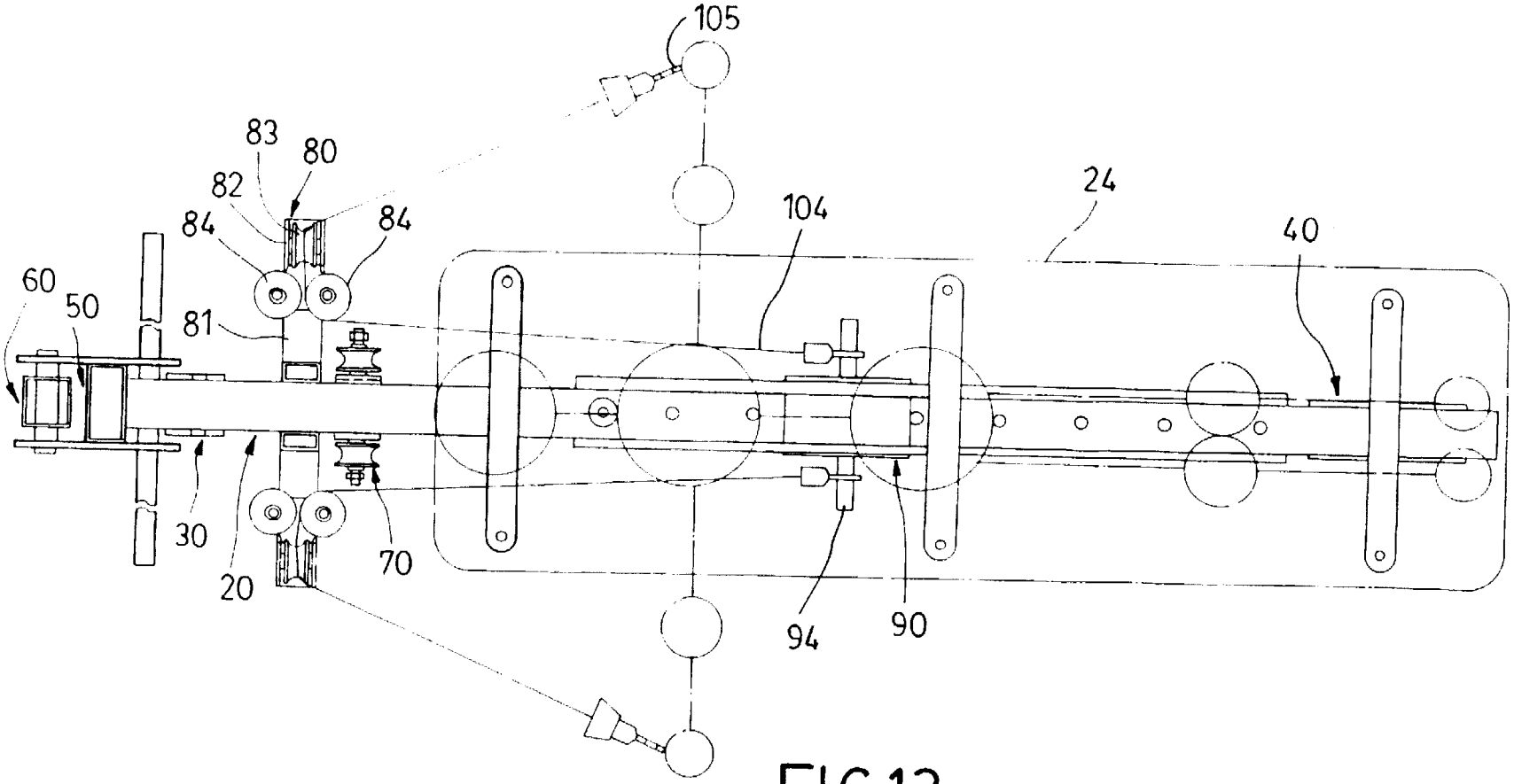
FIG. 12 is a schematic top view illustrating how the exerciser is used to expand the chest of the user according to the present invention.

Referring to FIG. 12, the user may lie down on the seat member 24 with his/her abdomen abutting the lower side of the transverse rod 213 of the U-shaped abutting member 21. At this time, the user may grasp two strips which are connected to the second hooking rings 105 and then raise his/her hands to an upright position and move the same away from each other to either side of the trunk to a substantially horizontal position in order to expand the chest. The second cords 104 will exert an resistant force on the user's arms when the user expands the chest. The T-shaped member 82 will be rotated by 90 degrees when the user's arms moved from the upright position to the horizontal position in order to ensure a smooth bending of the second cords 104, thereby facilitating the movement of the user's arms, as best illustrated in FIG. 12.

Figure 13:
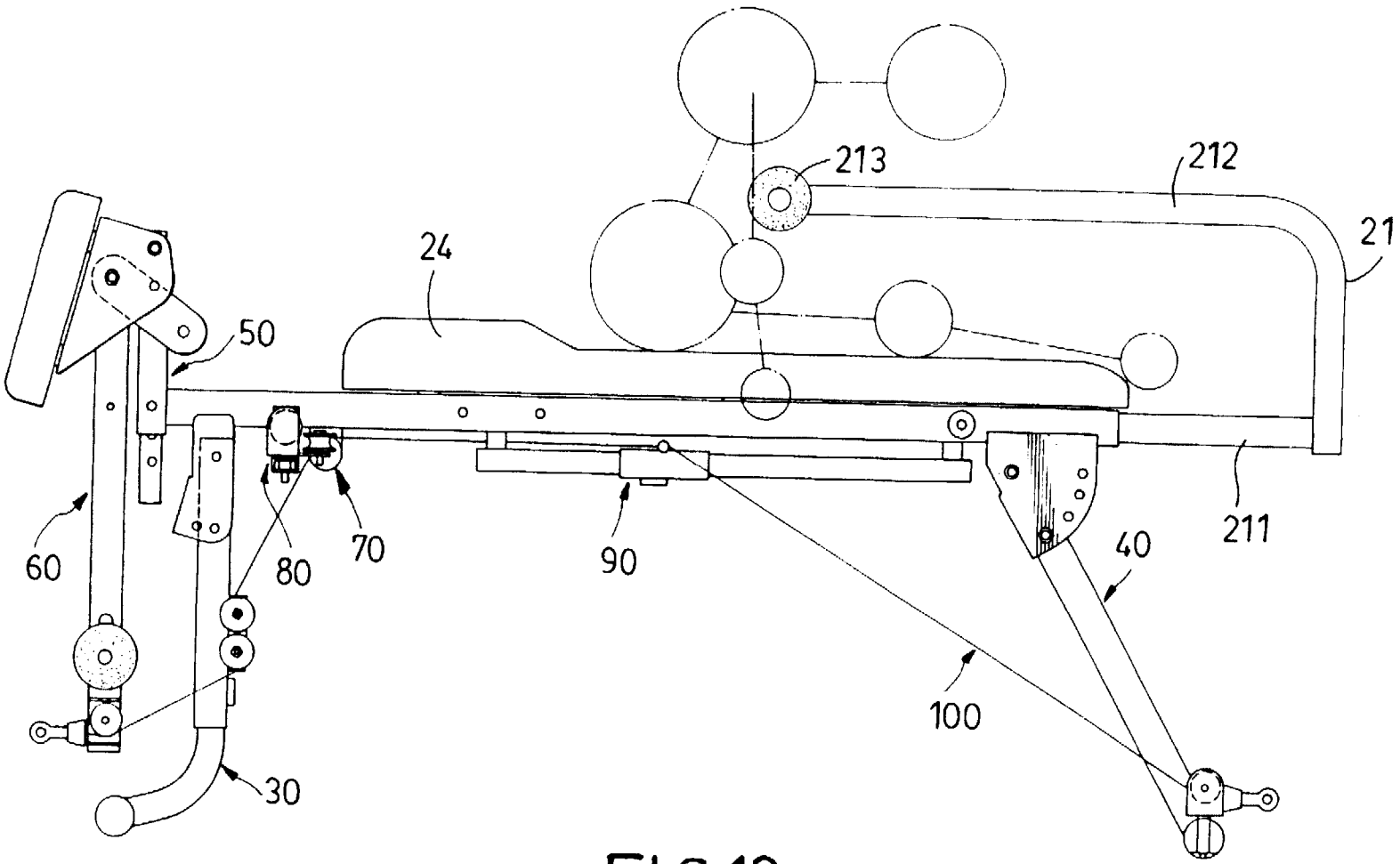
FIG. 13 is a schematic view illustrating how the exerciser is used to exercise the waist of the user according to the present invention.

Referring to FIG. 13, the user may lie down on the seat member 24 with his/her abdomen abutting the lower side of the transverse rod 213 of the U-shaped abutting member 21. The user can then sit up and lie down in order to exercise his/her abdomen. Since the user's abdomen abuts the transverse rod 213 during the sit-up exercise, the effect of the sit-up exercise is improved.

It is noted that the exerciser of the present invention can be used to exercise the legs, the arms, the spine, the abdomen and the chest of the user. Therefore, the object of the present invention is met.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. An exerciser comprising:

an elongated main frame having front and rear ends, and upper and lower side faces, said upper side faces having a seat member fixed thereto;

a front support rod having telescoping inner and outer tubes, said outer tube having an upper end and a first coupling member which interconnects said upper end of said outer tube and said front end of said main frame, said inner tube having a curved lower portion with a lower end, said lower end of said inner tube having a front bottom rod connected transversely thereto;

a rear support rod having upper and lower ends, a second coupling member interconnecting said upper end of said rear support rod, and a rear bottom rod connected transversely to said lower end of said rear support rod;

a spine-exercising device having telescoping inner and outer tubes, said outer tube of said spine-exercising device having an upper end and a lower end which is fixed to said front end of said main frame, said inner tube having an upper end, a U-shaped bracket connected to said upper end of said inner tube of said spine-exercising device, and an abutting plate fixed to said U-shaped bracket;

a leg-exercising device having a pair of elongated connecting plates which are fixed parallelly to said upper end of said outer tube of said spine-exercising device, and a swing rod having upper and lower ends, each of said connecting plates having upper and lower ends, said upper ends of said connecting plates being connected pivotally to said upper end of said swing rod, said lower ends of said connecting plates having a handle connected thereto;

a first pulley assembly having a pair of front pulleys, two pairs of first middle pulleys, a pair of second middle pulleys and a pair of rear pulleys, said front pulleys being mounted rotatably to said lower end of said swing rod, said first middle pulleys being mounted rotatably to said outer tube of said front support rod, said second middle pulleys being mounted rotatably to said lower side face of said main frame behind said front support rod, said rear pulleys being mounted rotatably to said lower end of said rear support rod;

a second pulley assembly having a mounting rod with two ends which is connected transversely to said main frame between said front support rod and said second middle pulleys, each end of said mounting rod having a generally T-shaped member which has a tail portion and a head portion transversely connected to said tail portion, each tail portion being connected pivotally to a respective one of said ends of said mounting rod and having a pair of opposed wing members extending upwardly therefrom, said wing members of each of said T-shaped members having a bobbin mounted rotatably therebetween, each of said head portions having a pair of guiding rollers mounted rotatably to an upper face thereof;

a tension-adjusting device mounted to said main frame between said second middle pulleys and said rear support rod and having a guiding rod which is fixed under said lower side face of said main frame, a slide tube which is sleeved slidably on said guiding rod, a fastening device for positioning releasably said slide tube to said guiding tube, and a retaining rod which is fixed to said slide tube;

two pairs of elastic cords including a pair of first cords and a pair of second cords, each of said first cords passing around a respective one of said front pulleys, a respective one pairs of said first middle pulleys, a respective one of said second middle pulleys, said retaining rod, and a respective one of said rear pulleys, each of said first cords having two ends, each end of a respective one of said first cords having a first retaining block and a first hooking ring connected thereto, said first retaining blocks abutting against said front pulleys and said rear pulleys in order to keep said first cords under tension, each of said second cords passing around said bobbin and one of said guiding rollers of a respective one of said ends of said mounting rod, each of said second cords having first and second ends, said first ends of said second cords having second hooking rings which are connected to said retaining rods of said tension-adjusting device, said second end of each of said second cords having a second retaining block and a third hooking ring connected thereto, said second retaining blocks abutting said bobbins of said second pulley assembly in order to keep said second cords under tension.

2. The exerciser as claimed in claim 1, wherein said rear end of said main frame has a U-shaped abutting member mounted thereto, said U-shaped abutting member having a first leg portion which is connected slidably to said main frame and a second leg portion located spacedly over said main frame, said second leg portion having a distal end, and a transverse rod connected to said distal end of said second leg portion.

3. The exerciser as claimed in claim 1, wherein said inner tube of said spine-exercising device has a coupling rod and a positioning hole extending transversely therethrough adjacent to said upper end of said inner tube of said spine-exercising device, said coupling rod having threaded holes in two ends thereof, said spine-exercising device further having a positioning pin passing through said U-shaped bracket and said positioning hole of said inner tube, and two screw members extending through said U-shaped bracket and engaging said threaded holes of said coupling rod of said inner tube in order to interconnect said U-shaped bracket and said inner tube.

4. The exerciser as claimed in claim 1, wherein said swing rod has a sleeve member extending transversely therethrough adjacent to said upper end thereof, said sleeve member having an outer sleeve and an inner sleeve received rotatably in said outer sleeve, said swing rod further has a pivot pin with two externally threaded ends extending through said upper ends of said connecting plates and said inner sleeve in order to connect pivotally said swing rod to said connecting plates.

* * * * *